US005810355A

United States Patent [19]

Trilli

[11] Patent Number: 5,810,355

[45] Date of Patent: Sep. 22, 1998

[54] APPARATUS FOR HOLDING MULTIPLE DECKS OF PLAYING CARDS

[76] Inventor: Pasquale Trilli, 2700 Linden Ave., North Brunswick, N.J. 08902

[21] Appl. No.: 711,344

[22] Filed: Sep. 5, 1996

[51] Int. Cl.[6] ..... A63F 1/12

[52] U.S. Cl. ..... 273/149 R

[58] Field of Search ..... 273/148 R, 148 A, 273/149 R, 149 P

[56] References Cited

U.S. PATENT DOCUMENTS

| | | | |
|---|---|---|---|
| 296,356 | 4/1884 | Robin . | |
| 957,784 | 5/1910 | Liebert . | |
| 1,757,553 | 5/1930 | Tauschek . | |
| 1,930,844 | 10/1933 | Ruddell . | |
| 2,731,271 | 1/1956 | Brown . | |
| 2,747,877 | 5/1956 | Howard . | |
| 2,831,742 | 4/1958 | Pape . | |
| 3,232,622 | 2/1966 | Lambert . | |
| 4,659,082 | 4/1987 | Greenberg | 273/148 R |
| 4,667,959 | 5/1987 | Pfeiffer et al. . | |
| 5,405,077 | 4/1995 | Damon . | |

*Primary Examiner*—George Manuel
*Attorney, Agent, or Firm*—Plevy & Associates

[57] ABSTRACT

An apparatus for holding a plurality of shoes each of which contain a deck of playing cards. The apparatus includes a housing and a carousel rotatively mounted within the housing. The carousel has a plurality of shoe holding receptacles for holding the shoes. The shoe holding receptacles each include a shoe ejecting mechanism for ejecting the shoe contained in the receptacle after the carousel is rotated. Accordingly, a card dealer can deal the deck of cards contained in the ejected shoe without the need for shuffling the cards of the deck.

20 Claims, 4 Drawing Sheets

APPARATUS FOR HOLDING MULTIPLE DECKS OF PLAYING CARDS

FIELD OF INVENTION

The present invention relates generally to game accessories and more particularly to a carousel apparatus for holding multiple decks of playing cards which can be randomly selected and dealt without shuffling.

BACKGROUND OF THE INVENTION

The prior art includes many devices and accessories for holding, shuffling, and dealing playing cards. One such device is disclosed in U.S. Pat. No. 2,731,271 entitled COMBINED DEALER, SHUFFLER, AND TRAY FOR PLAYING CARDS, issued to Brown on Jan. 17, 1956. This patent describes a card shuffling and dealing device which comprises a base having a number of stations where the shuffled or dealt cards accumulate, and a rotatable tray having two magazines each for a deck or stack of cards. The magazines feed the cards to the shuffling mechanism which comes into play as the tray is rotated. These magazines include a swinging combined shelf and cover which enables the magazines to store the remainder of the deck in the discard stack. The device handles two stacks of cards and alternately deposits a card from each of these stacks at a plurality of different stations. The device shuffles the cards by ejecting the bottom cards of the stacks and deals cards by ejecting the bottom card of a single stack.

U.S. Pat. No. 2,747,877 entitled CARD SHUFFLING MECHANISM, issued to Howard on May 29, 1956. This patent describes a card shuffling machine which comprises a spring motor which drives the device, a card releasing trap adapted to provide cocking or setting means for the spring motor, a card shuffling mechanism in a form of a horizontally traveling trap which moves from beneath a plurality of card of stacks and releases the cards so that they shuffle gravitatingly into a delivery chamber.

U.S. Pat. No. 3,232,622 entitled SPINNER-TYPE CARD GAME APPARATUS, issued to Lambert on Feb. 1, 1966. This patent describes a card game apparatus which includes a stationary base which functions as a playing field and supports a rotatable card hand holding and dealing wheel for rotation on top of the stationary base. The dealing wheel is provided with circumferentially spaced holders or receivers each of which is designed and adapted to hold the game participants' card hands in a manner so that the same are dealt out to the players. The rotatable dealing wheel is driven by an electric motor which is controlled by a switch button which is pressed and subsequently released at will by the user.

U.S. Pat. No. 4,667,959 entitled APPARATUS FOR STORING AND SELECTING CARDS, issued to Pfeiffer et al. on May 26, 1987. This patent discloses a card apparatus having a card hopper which is adapted for holding one or more cards, a card carousel having slots for holding cards and an injector for sequentially loading cards from the hopper into the carousal, and ejectors for delivering cards from carousel to any one of the output cards and a control board with sensors all housed in a housing. The apparatus is capable of communicating with selectors which are adjustable for making card selections. The injector has three rollers which are driven by a motor. A spring loaded lever keeps cards in the hopper pressed against the first roller. The ejectors are pivotally mounted to the base of the housing beneath the carousel and comprise a roller driven by a motor. The control board keeps track of the identity of the cards in each slot, card selections, and the carousel position. Cards may be ordinary playing cards or other cards with barcodes added for card identification by the apparatus.

A problem common to all the devices described above is that they all rely on some type of card shuffling or selecting mechanism for randomizing the playing cards. Such mechanisms add to the cost and complexity of the device resulting in devices which are difficult and expensive to manufacture, cumbersome to use, and sometimes unreliable.

It is, therefore, an object of the present invention to provide a game card carousel apparatus which eliminates the complex card shuffling and selecting mechanisms of the prior art while still allowing playing card decks to be randomly selected and dealt without shuffling.

SUMMARY OF THE INVENTION

An apparatus for holding a plurality of shoes each of which contain a deck of playing cards, comprising a housing and a carousel rotatively mounted to the housing. The carousel has means for holding the plurality of shoes. The shoe holding means includes means for ejecting one of the shoes from the carousel after the carousel is rotated, wherein a card dealer can deal the deck of cards contained in the ejected shoe without the need for shuffling the cards of the deck.

BRIEF DESCRIPTION OF THE DRAWINGS

For a detailed understanding of the present invention, reference should be made to the following detailed description taken in conjunction with the accompanying drawings wherein.

DETAILED DESCRIPTION OF THE INVENTION

Although the present invention can be used as a game accessory in many different applications where multiple decks of any of type of playing cards are used, the present invention is especially suited for use with standard playing cards and in games such as Blackjack, Poker and the like.

Figure 1:
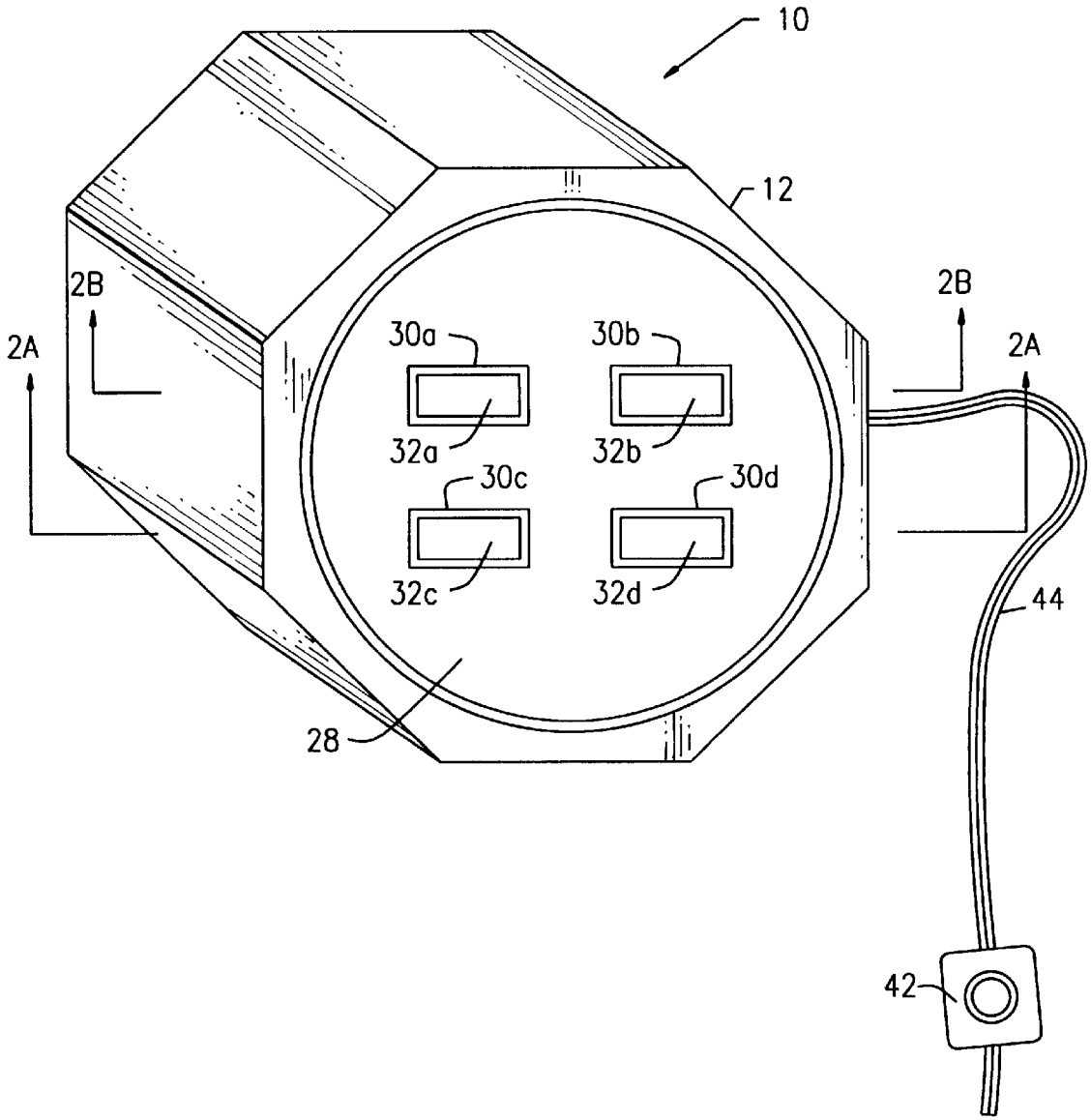
FIG. 1 is a perspective view of the game card carousel of the present invention.

With reference now to the drawings, and in particular to FIG. 1, an embodiment of the game card carousel apparatus according to the principles and concepts of the present invention is shown and generally designated by the reference numeral 10.

The game card carousel apparatus 10 includes a hollow, hexagonal-shaped main housing 12 which includes a carousel member 28 which can be rotated relative to the main housing 12. The carousel member 28 includes a plurality of shoe receptacles 30*a*, 30*b*, 30*c*, and 30*d*, which are each sized to receive a corresponding shoe which holds deck of playing cards, the shoes being identified by numerals 32*a*, 32*b*, 32*c*, and 32*d*. In order to simplify the illustration of the apparatus 10, only four shoe receptacles are shown in FIG. 1, however, it should be understood that in the actual practice of the invention, many more shoe receptacles can be employed in the carousel member. Each deck of cards contained in the shoes is either one of two different colors, such as red and blue or any other pair of colors. Accordingly, every shoe receptacle in the carousel member is correspondingly identified as either a red position or a blue position in an alternating manner.

In any case, the carousel member 28 is electrically driven by energizing a remotely connected button activated switch 42. In the embodiment shown, the switch 42 is coupled to the apparatus 10 by a wire 44, however, a wireless button activated switch can also be is employed.

Figure 2A:
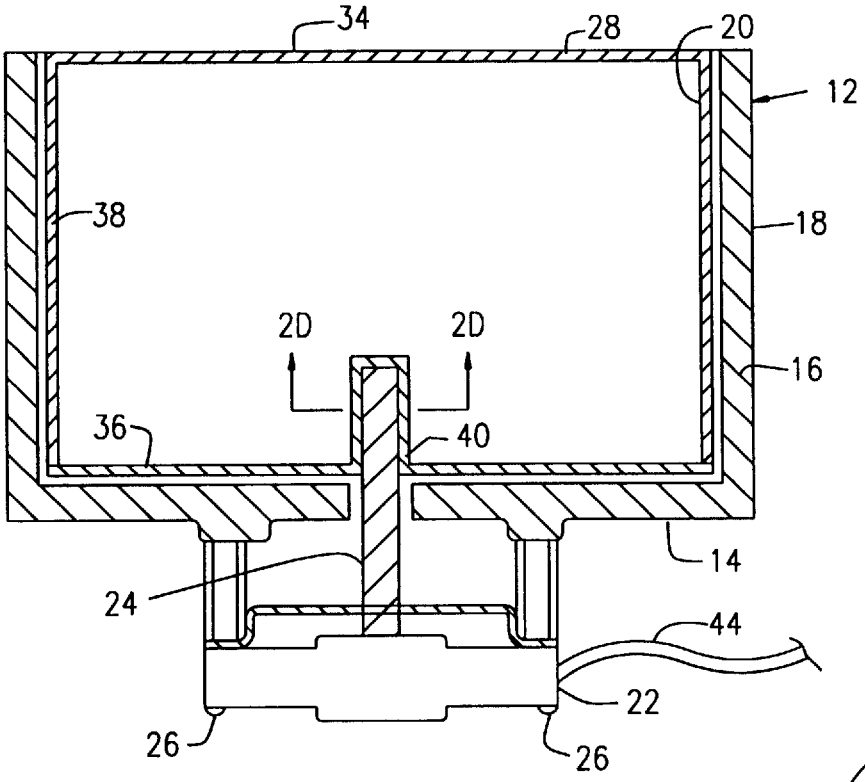
FIG. 2A is a cross-sectional side view through line 2A—2A of FIG. 1.

Referring to FIG. 2A, there shown a cross-sectional view through line 2A—2A of FIG. 1 which illustrates a preferred method for rotating the carousel member relative to the main housing. As can be seen, the main housing 12 has mounted thereto, an electric motor 22 which drives the carousel member via a drive shaft 24. The electric motor is mounted to a base wall 14 of the main housing by conventional screw-type fasteners 26 or other like means. The switch 42 is electrically coupled to the electric motor 22 by the wire 44. The carousel member 28 is rotatively housed within a sidewall 16 of the main housing 12 which extends from the base wall 14. The sidewall 16 includes a hexagonal-shaped outer surface 18 as can be seen in FIG. 1, and a cylindrical-shaped inner surface 20 which is sized to rotatively receive the carousel member 28.

Figure 2D:
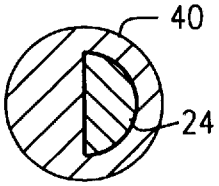
FIG. 2D is a cross-sectional side view through line 2D—2D of FIG. 2A.

The carousel member preferably includes an outer wall 34, an inner wall 36, and a cylindrical-shaped sidewall 38 extending between the outer wall 34 and the inner wall 36. The inner wall 36 defines a shaft receiving collar 40 which is sized to receive the free end of the drive shaft 24 in a press fit or like manner. The free end of the drive shaft 24 can be keyed to the collar 40 of the inner wall 36 of the carousel member 28 in order to prevent the drive shaft 24 of the electric motor 22 from slipping within the collar 40 when the motor 22 is activated. This can be accomplished for example, by making both the free end of the drive shaft 24 and the collar 40 of the inner wall 36 a D-shape as shown in FIG. 2D.

Figure 2B:
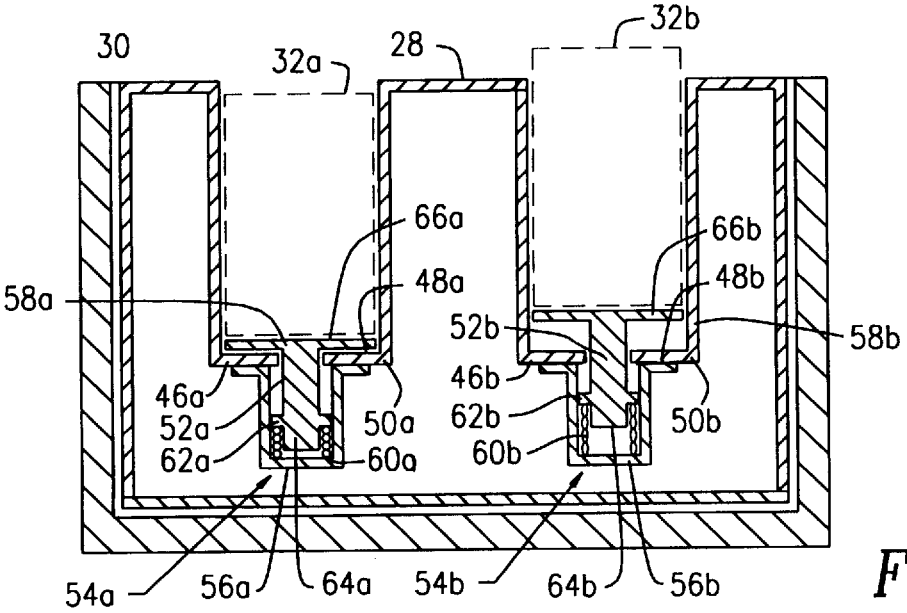
FIG. 2B is a cross-sectional side view through line 2B—2B of FIG. 1.
Figure 2C:
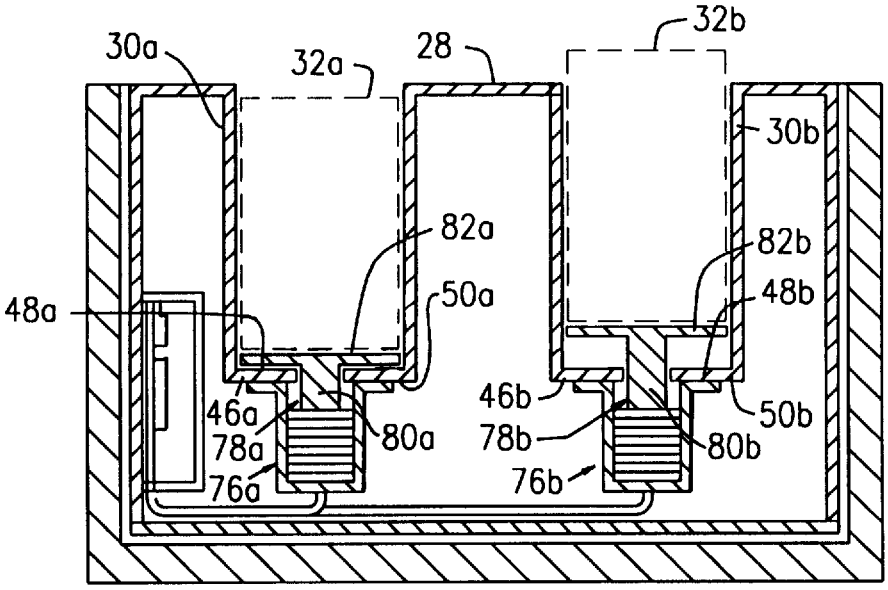
FIG. 2C is a cross-sectional side view which show an another embodiment of the shoe ejecting mechanism of the present invention.

Referring to FIG. 2B, a cross-sectional view through line 2B—2B of FIG. 1 is shown which details the construction of the shoe receptacles 30*a*–30*d*. As can be seen, the shoe receptacles (only shoes receptacles 30*a* and 30*b* are shown in this view) are defined in the outer wall 34 of the carousel member 28. Each shoe receptacle 30*a* and 30*b* includes an end wall 46*a* and 46*b* having outer surfaces 48*a*, 48*b* and inner surfaces 50*a*, 50*b* and apertures 52*a*, 52*b*. Attached to the inner surface of each end wall is a mechanism 54*a*, 54*b* for ejecting the shoe from the shoe receptacle. The shoe ejecting mechanism can be embodied as a simple dual-position spring biased plunger arrangement as shown in FIG. 2B or as a electromechanical solenoid arrangement as shown in FIG. 2C.

Each mechanical shoe ejecting mechanism shown in FIG. 2B includes an enclosure 56*a*, 56*b* which houses a T-shaped plunger 58*a*, 58*b* that is biased by a coil spring 60*a*, 60*b* that extends between a spring retaining flange 62*a*, 62*b* disposed on the plunger 58*a*, 58*b* and the enclosure 56*a*, 56*b*. The T-shaped plunger 58*a*, 58*b* has an elongated body portion 64*a*, 64*b* that extends through the aperture 52*a*, 52*b* of the end wall 46*a*, 46*b* and a planar shoe engagement portion 66*a*, 66*b* that reciprocates away and toward the outer surface 48*a*, 48*b* of the end wall 46*a*, 46*b*. A conventional push and lock/push and unlock, reciprocating latching arrangement (not shown) enables the plunger to be locked in a retracted position and unlocked in an extended position. Such latching arrangements are well known in the art and are typically used in latches that are used for locking and unlocking the hinged doors of wall units, television stands and the like. The shoe receptacle 30*a* illustrates the shoe ejecting mechanism 54*a* in the locked-retracted position and the shoe receptacle 30*b* illustrates the shoe ejecting mechanism 54*b* in the locked-extended position. In particular, the shoe receptacle 30*a*, shows the plunger 58*a* pushed into the locked-retracted position which compresses the spring 60*a* when the shoe 32*a* is placed into the shoe receptacle 30*a*. The shoe receptacle 30 b, shows how the stored shoe 32*b* is ejected when a user manually pushes the shoe a short distance into the shoe receptacle 30*b* thereby unlocking the plunger 58*b* and allowing the compressed spring 60*b* to move the shoe 32*b* partially out of the shoe receptacle 30*b* so that the user can easily grasp and fully remove the shoe from the carousel member 28.

Figure 3A:
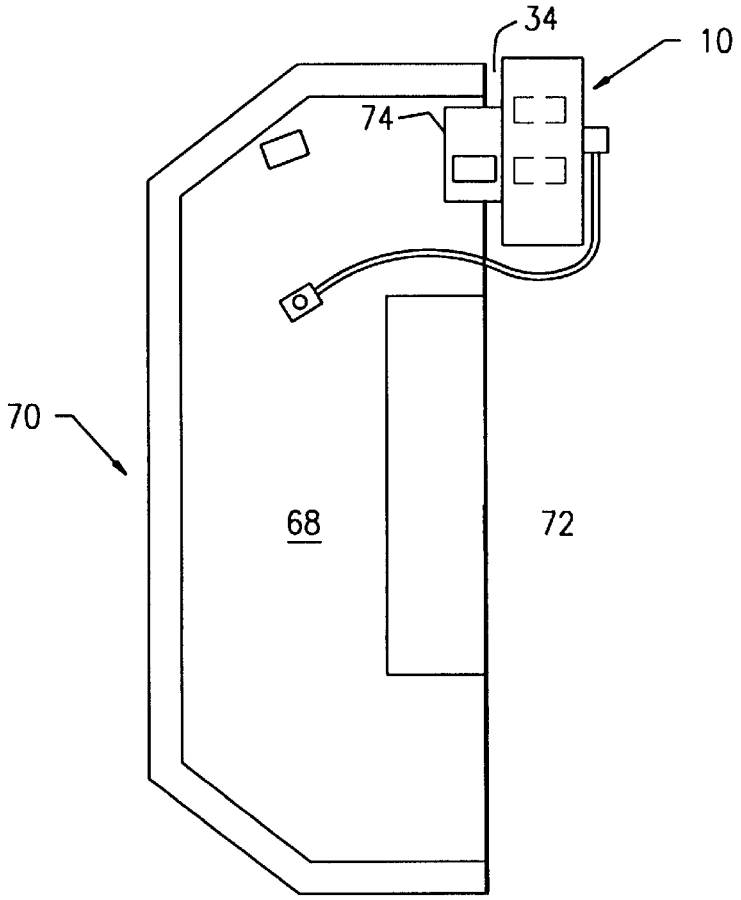
FIG. 3A is a schematic view of the game card carousel of the present invention as implemented in a typical card game setting that one might see in a gambling casino.
Figure 3B:
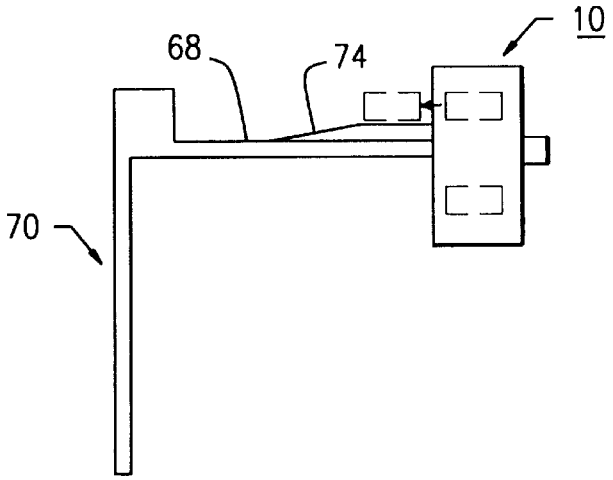
FIG. 3B is a side view of the present invention and the card table.

Referring to FIGS. 3A and 3B the operation of the card holding apparatus of the present invention will now be described. FIG. 3A shows the how the apparatus can be implemented in a typical card game setting that one might see in a gambling casino. The game setting includes a card table with a game player position 70 and a dealer station 72.

The card holding apparatus 10 of the invention is positioned next to the dealer station 72 so that it faces the game player position 70 of the table 68. The button activated switch 42 is positioned on the table 68 such that either the dealer or one of the game players can operate it. A ramp 74 which allows the shoes to be slidingly removed from the carousel member is position immediately in front of the outer wall 34 of the carousel member 28 of the apparatus 10. This is best seen in FIG. 3B.

When a new deck of cards is required during the course of a card game, either the dealer or the game player activates the button activated switch. This causes the motor to rotate the carousel member. Upon the release of the button, the carousel member stops and one of the shoes in the red or blue shoe receptacle position is selected by manually pushing the selected shoe a short distance into the shoe receptacle thereby unlocking the plunger and allowing the compressed spring to move the selected shoe partially out of the shoe receptacle b so that it can be easily grasped and slidingly moved down the ramp situated in front of the carousel member. Accordingly, the dealer can deal the deck of card in the selected shoe without having to shuffle the cards. An already dealt deck of cards can then be placed into an empty shoe, and the shoe placed into the vacated shoe receptacle.

An alternative shoe ejecting mechanism is shown in FIG. 2C. In the alternative design, conventional electromechanical solenoids 76*a*, 76*b* are attached to the inner surfaces 50*a*, 50*b* of the shoe receptacles 30*a*, 30*b*. Each solenoid 76*a*, 76*b* has a reciprocating T-shaped plunger 78*a*, 78*b* similar to the plungers described in FIG. 2B. The T-shaped plunger of each solenoid has an elongated body portion 80*a*, 80*b* which extends through the aperture 52*a*, 52*b* of its associated end wall and a planar shoe engagement portion 82*a*, 82*b* that reciprocates away and toward the outer surface 48*a*, 48*b* of the end wall 46*a*, 46*b*. Each solenoid 76*a*, 76*b* is connected to a microprocessor control unit 84 that automatically energizes one of the solenoids in a random manner when the carousel member 28 stops rotating. The solenoid 76*a* is shown in the non-energized, retracted position which allows the shoe 32*a* to be retained in the shoe receptacle 30*a*. The solenoid 76*b* is shown in the energized-extended position which ejects the shoe 32*b* from the shoe receptacle 30*b* so that the user can easily grasp and fully remove the shoe 32*b* from the carousel member 28.

It should be understood that the embodiments described herein are merely exemplary and that a person skilled in the art may make many variations and modifications to these embodiments utilizing functionally equivalent elements to those described herein. Any and all such variations or modifications as well as others which may become apparent to those skilled in the art, are intended to be included within the scope of the invention as defined by the appended claims.

I claim:

1. An apparatus for holding a plurality of shoes each of which contain a deck of playing cards, comprising:

a housing; and a carousel rotatively mounted to said housing, said carousel having means for holding the plurality of shoes, said shoe holding means including means for ejecting one of the shoes from said carousel after said carousel is rotated, wherein a card dealer can deal the deck of cards contained in the ejected shoe without the need for shuffling the cards of the deck.

2. The apparatus according to claim 1, further comprising means for rotating said carousel relative to said housing.

3. The apparatus according to claim 2, further comprising means for actuating said means for rotating said carousel.

4. The apparatus according to claim 3, wherein said actuating means includes a manually operated switch.

5. The apparatus according to claim 4, wherein said switch includes a wireless switch.

6. The apparatus according to claim 2, wherein said rotating means includes an electric motor coupled to said carousel.

7. The apparatus according to claim 1, wherein said ejecting means includes a reciprocating T-shaped plunger for ejecting a shoe contained therein.

8. The apparatus according to claim 7, wherein said ejecting means includes a spring for biasing said plunger.

9. The apparatus according to claim 8, wherein said ejecting means includes a push and lock/push and unlock, latching means which enables said plunger to be locked in a retracted position and unlocked in an extended position.

10. The apparatus according to claim 7, wherein said ejecting means includes a solenoids for reciprocating said T-shaped plunger.

11. The apparatus according to claim 10, wherein said ejecting means includes a controller for actuating said solenoid.

12. An apparatus for holding a plurality of shoes each of which contain a deck of playing cards, said apparatus comprising:

a housing; and a carousel rotatively mounted within said housing, said carousel having a plurality of receptacles each of which hold a shoe containing a deck of playing cards, each of said receptacles including means for ejecting the shoe from the receptacle after said carousel is rotated, wherein a card dealer can remove one of the shoes from said apparatus and deal the deck of cards contained therein without the need for shuffling the cards of the deck.

13. The apparatus according to claim 12, further comprising means for rotating said carousel relative to said housing.

14. The apparatus according to claim 13, further comprising a manually operated switch.

15. The apparatus according to claim 13, wherein said rotating means includes an electric motor coupled to said carousel.

16. The apparatus according to claim 12, wherein said ejecting means includes a reciprocating T-shaped plunger in each receptacle for ejecting a shoe contained therein.

17. The apparatus according to claim 16, wherein said ejecting means includes a spring for biasing said plunger.

18. The apparatus according to claim 17, wherein said ejecting means includes a push and lock/push and unlock, latching means which enables said plunger to be locked in a retracted position and unlocked in an extended position.

19. The apparatus according to claim 16, wherein said ejecting means includes a plurality of solenoids each of which reciprocates one of said T-shaped plungers.

20. The apparatus according to claim 19, wherein said ejecting means includes a controller for randomly selecting one of said plurality of solenoids.

* * * * *